United States Patent [19]

Rookus

[11] 4,028,799

[45] June 14, 1977

[54] SHARPENERS FOR ELECTRIC SHAVERS

[76] Inventor: James E. Rookus, 505 Cherry, SE., Grand Rapids, Mich. 49503

[22] Filed: Dec. 17, 1975

[21] Appl. No.: 641,661

Related U.S. Application Data

[63] Continuation-in-part of Ser. No. 478,645, June 12, 1974, Pat. No. 3,935,638, which is a continuation-in-part of Ser. No. 436,174, Jan. 24, 1974, abandoned.

[52] U.S. Cl. ..... 30/37; 30/138; 51/241 S

[51] Int. Cl.[2] ..... B26B 19/38

[58] Field of Search ..... 30/35, 37, 38, 43.92, 30/138; 51/241 R, 241 S

[56] References Cited

UNITED STATES PATENTS

| | | | |
|---|---|---|---|
| 1,571,555 | 2/1926 | Niesen | 30/35 X |
| 1,824,531 | 9/1931 | Bennett | 30/37 X |
| 2,953,851 | 9/1960 | Wheeler | 30/35 |
| 3,513,602 | 5/1970 | Fisher | 51/241 R |
| 3,932,967 | 1/1976 | Hanes | 30/35 X |
| 3,935,638 | 2/1976 | Rookus | 30/37 |

OTHER PUBLICATIONS

Grinding Technology; Stephen Krar and J. William Oswald; Delmar Publishers, Albany, New York; 1974; pp. 7 & 57.

*Primary Examiner*—Gary L. Smith
*Attorney, Agent, or Firm*—Price, Heneveld, Huizenga & Cooper

[57] ABSTRACT

A sharpener apparatus for an electric shaver of the type having cooperable cutting elements including a cutting head equipped with one or more motor driven cutting blades. The sharpener is positioned between the shear plate and blade and includes a thin sheet having an abrasive material thereon suitable for sharpening the blade or for engagement with and honing the inner surface of the shear plate. In one embodiment, the thin sheet is of size and shape that it is held by the ends of the shaver housing when sharpening the blade. In another embodiment, means are included on the thin sheet for holding the thin sheet on and for movement with the cutting blade to recondition or hone the head. In either embodiment, operation of the shaver's blade drive motor will drive the cutter blade while it either engages the abrasive surface as in the first embodiment or in the second embodiment moves the abrasive surface over the head.

7 Claims, 11 Drawing Figures

SHARPENERS FOR ELECTRIC SHAVERS

CROSS REFERENCE TO RELATED APPLICATION

This application is a continuation-in-part application of Ser. No. 478,645 filed by Applicant on June 12, 1974, now U.S. Pat. No. 3,935,638 entitled SHARPENER FOR ELECTRIC SHAVERS which in turn is a continuation-in-part of now abandoned application Ser. No. 436,174 filed by Applicant on Jan. 24, 1974.

BACKGROUND OF THE INVENTION

Electric shavers have a stationary screen or shear plate behind which a driven blade is reciprocated to shave the user by shearing the individual hairs which project through openings in the shear plate. In the type of shaver to which this invention applies, the blade has a plurality of cutting edges formed thereon and is reciprocated while pressed firmly against the inner face of the shear plate. After repeated use, these cutting edges become dull and the inner surface of the shear plate becomes rough. When this happens, it is conventional paractice to replace the blade and shear plate. This is both an expensive and a wasteful practice.

SUMMARY OF THE INVENTION

The invention provides a simple and inexpensive means for sharpening the blade and for reconditioning the corresponding surfaces of the shear plate in an electric shaver. In the type of electric shaver to which this invention applies, the head assembly of the shaver is removable from the housing which contains the drive motor and like components. The removable head assembly includes one or more blade and shear plate subassemblies contained in the head assembly housing in which they are mounted. The head assembly is held in place on the housing by a pair of biased end wall members which abut the head assembly at opposite ends thereof. The invention, when used for sharpening the blade, provides a thin sheet having an abrasive surface formed thereon which is held in place by the end walls and designed to engage the cutting edges of the blade. To recondition or hone the shear plate, a similar thin sheet having an abrasive surface formed thereon is positioned on the blade for movement therewith. When the abrasive is positioned on the shear plate, operation of the motor of the shaver causes the blade to be sharpened by the abrasive surface. When the abrasive is positioned adjacent the inner surface of the shear plate and reciprocated with the blade, the shear plate is honed to smooth its surface and increase its cooperative cutting efficiency with the sharpened blade. The sharpening device is ligh-weight compact and inexpensive since it utilizes the shaver's existing power pack.

The invention will be more clearly understood upon reading the following description and the accompanying drawings.

DESCRIPTION OF THE PREFERRED EMBODIMENTS

Figure 1:
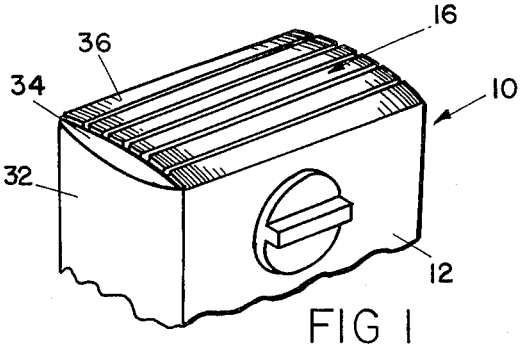
FIG. 1 is a fragmentary oblique view of a shaver with which this invention can be used.
Figure 2:
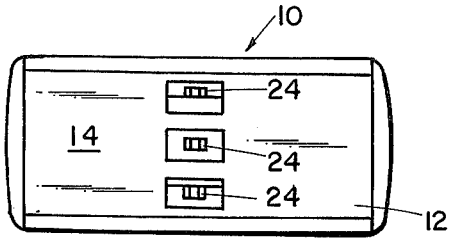
FIG. 2 is a top plan view of the shaver with the shaving head assembly removed.

FIGS. 1 and 2 illustrate a typical electric shaver 10 having a housing 12 encasing a motor. One end of the housing is open to provide a recessed seat 14 (FIG. 2), to receive a removable shaving head assembly 16. Electric shavers of this type may have one or more cutter sub-assemblies 18 positioned together to form the head assembly 16. The illustrated shaver has three cutter sub-assemblies 18, each including a movable cutter or blade element 20 (FIGS. 4 and 5) and a peforated screen or shear plate 22. Each blade 20 is individually reciprocated by one of the several drive fingers 24 driven by the motor. Removal of shaving head 16 from recess 14 exposes the fingers.

Figure 3:
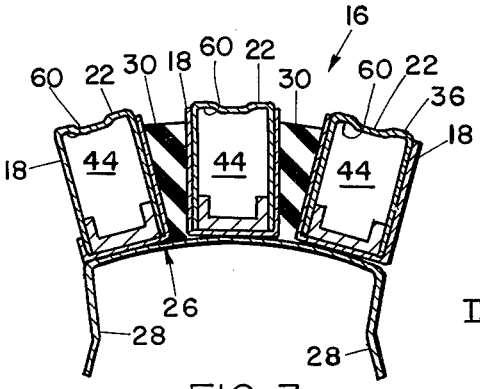
FIG. 3 is a cross-sectional view of the shaver head assembly with the cutting elements or blades removed.

Head assembly 16 is of conventional construction for this type of electric shaver and includes one or more of the previously mentioned shear plates 22 each containing a blade 20. The shear plates, as shown in FIG. 3, are fixed on a base member 26 (FIG. 3) which includes a pair of downwardly depending resilient leg members 28. The shear plates 22 are arranged on base member 26 and spaced apart by members 30 in a well-known conventional manner. It will be understood that one or a plurality of such shear plates 22 and blades 20 may be provided in the head assembly of an electric shaver of the type to which the instant invention is applicable.

Figure 7:
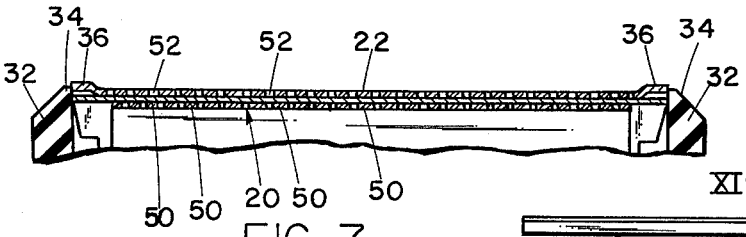
FIG. 7 is a view taken in the same plane as FIG. 6 but showing a thin sheet abrasive element in a blade sharpening position.
Figure 6:
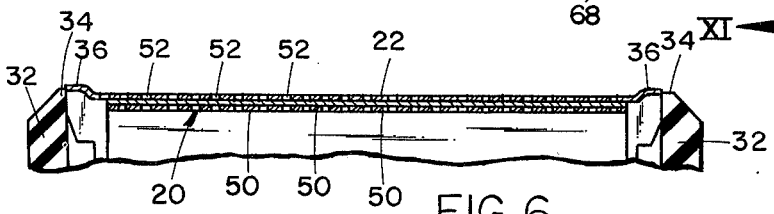
FIG. 6 is a sectional view taken along the plane VI—VI of FIG. 4 illustrating a thin sheet abrasive element in a shear plate honing position.

Head assembly 16 is held in position in housing 12 by the engagement of resilient leg members 28 extending into recess 14 (FIG. 2) formed in the top of the shaver housing 12 and additionally by end walls 32 formed on the housing which extend upwardly along the sides of housing 12 adjacent the elongated head assembly 16. As shown in FIGS. 1, 6 and 7, when head assembly 16 is operatively positioned in recess 14, end walls 32 terminate at their upper ends 34 just slightly below the uppermost surface 36 of shear plates 22.

Figure 4:
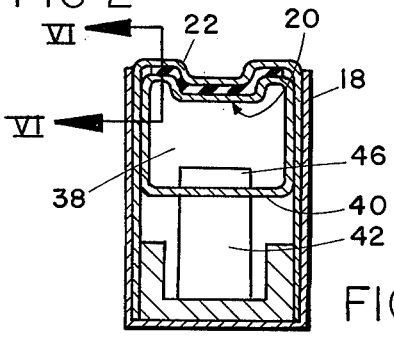
FIG. 4 is an enlarged cross-sectional view similar to FIG. 3 illustrating a single segment or sub-assembly of a multi-element head assembly with the blade and a thin sheet abrasive element positioned therein.
Figure 5:
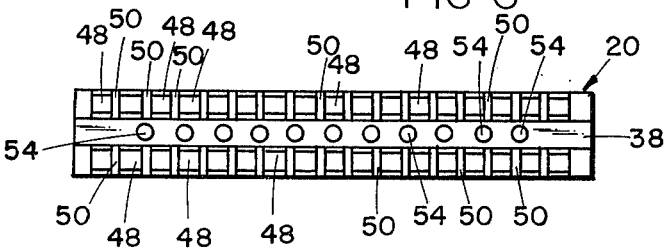
FIG. 5 is a plan view of a blade of the type incorporated in the head and which can be sharpened by this invention.

With reference to FIGS. 4 and 5, the movable cutting element or blade 20 includes an elongated body portion 38, a bottom plate 40 (FIG. 4) and a spring 42. The cutter body 38 is generally rectangular in cross-sectional configuration conforming generally along its side and top surface to the configuration of the inner surface or channel 44 (FIG. 3) formed in the corresponding shear plate 22. Spring 42 is a leaf-type spring and extends generally along the length of the blade 20. The ends of the spring are secured to bottom plate 40 by tabs 46 extending through suitable slots formed in the bottom plate. Between its ends, the spring extends generally downwardly and has an upwardly extending pocket (not shown) formed therein for receiving the drive fingers 24 on the shaver housing. The engagement of fingers 24 in the pocket of the spring provides the means for driving the blades in conventional fashion.

The upper surface of the blade has numerous narrow transverse slots 48 (FIG. 5) on opposite sides which divide this surface into a plurality of closely spaced knives 50 which in cooperation with corresponding transverse perforations or slots 52 (FIGS. 6 and 7) in shear plate 22 do the actual cutting or shaving. A plurality of openings 54 are centrally positioned and spaced along the axial length of the body portion 38 of the blade 20. The openings 54 are positioned centrally between the individual knives 50 formed at the sides of the elongated blade. Openings 54 are typically conventionally formed in the blade used in electric shavers of the type disclosed.

Figure 8:
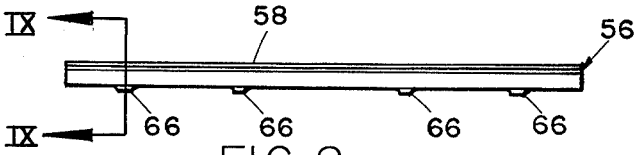
FIG. 8 is a side view of the abrasive element shown in FIG. 6.
Figure 9:
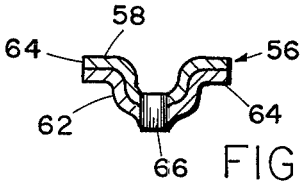
FIG. 9 is an enlarged end view of the abrasive element of FIG. 8.

Referring to FIGS. 8 and 9, a thin sheet of material 56 having an abrasive surface 58 formed thereon is adapted for positioning between the blade 20 and the inner upper surface 60 (FIG. 3) of shear plate 22 to recondition or hone the inner surface of the shear plate. The thin sheet 56 is elongated having a length corresponding generally to that of the blade 20. The width of thin sheet 56 having abrasive surface 58 formed thereon has a width closely corresponding to the width of blade 20 and the width of the inner surface 62 of the shear plate. The thin sheet and the abrasive surface may be formed as in integral piece or as shown in FIG. 9, formed as a two-piece assembly including the abrasive surface 58 bonded to a metallic base or sutstrate 62. In cross-sectional configuration, the assembly of base 62 and abrasive surface 58 is somewhat generally U-shaped having a pair of outwardly extending arms 64 which when positioned in the head assembly match with the raised perforated portion of shear plate 22. Base 50 includes a plurality of spaced apart dimples or detents 66 which extend slightly below the lower surface of the base. These dimples 66 are provided to engage with the corresponding openings 54 formed in the central part of blade 20. The dimples 66 in cooperation with openings 54 hold the thin sheet and abrasive in position and prevent shifting of the abrasive surface with respect to the blade when it is installed between the blade 20 and shear plate 22 (FIG. 6) as will be hereinafter described.

Figure 10:
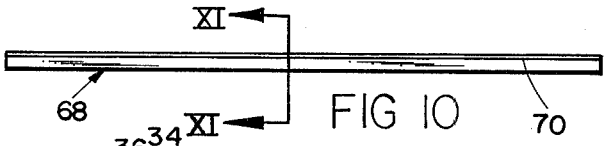
FIG. 10 is a side view of the abrasive element shown in FIG. 7.
Figure 11:
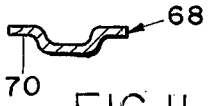
FIG. 11 is an enlarged end view of the abrasive element of FIG. 10.

With reference to FIGS. 10 and 11, a similar elongated thin sheet 68 for sharpening the blade is provided. Thin sheet 68 has at least one surface upon which an abrasive material 70 is deposited. Thin sheet 68 and its abrasive surface 70 is also elongated and has a length corresponding generally to the overall length of shear plate 22 (FIG. 7). The thin sheet 68 has a width corresponding generally to the width of shear plate 22 and is formed so as to have a cross-sectional configuration corresponding generally to that of the inner surface 60 of the shear plate.

To sharpen a blade, the head assembly 16 is removed from the housing 12 and the blade is removed. Thin sheet 70 of FIGS. 10 and 11 is positioned with its abrasive surface 70 facing downwardly adjacent the top surface of the blade and is inserted with the blade into channel 44 in shear plate 22 such that the thin sheet extends along the length of the shear plate from one end to the other. As mentioned previously, the thin sheet has a length corresponding generally to the overall length of shear plate 22 such that when inserted therein and when the head assembly 16 is positioned in the recess 14 of the shaver, the thin sheet extends between end walls 32 of the shaver housing. Thus, the thin sheet is held from movement with respect to the shear plate by the end walls. The spring 42 is compressed against the bottom plate 40 of the blade and the bias of the spring supports the top or knife surface of the blade against the abrasive surface 70 of thin sheet 68. When the motor of the shaver is activated, the blade is reciprocated against the abrasive surface 70 causing the blade to be sharpened. The length of the sharpening cycle will vary somewhat, of course, depending upon the condition of the blade; however, normally operating the motor for about 25 to 35 seconds is sufficient to fully restore the blade's sharpness.

When the blade has been sharpened in the manner described above, it is generally desirable to also recondition inner surface 60 of the shear plate. This reconditioning takes place by a honing operation utilizing the thin sheet with abrasive surface as shown in FIGS. 8 and 9. To hone inner surface 60 of the shear plate, the thin sheet 56 is positioned on the blade 20 such that dimples or detents 66 engage the corresponding openings 54 in the central portion of the blade. Thin sheets 56 is positioned to extend along the length of the blade which is then inserted in the manner previously described in channel 44 formed in shear plate 22 with the abrasive surface 58 engaging inner surface 60 of the shear plate (FIG. 6). As mentioned above, the bias of spring 42 supports the blade and thin sheet abrasive 58 against the upper inner surface 60 of shear plate 22. When the motor of the shaver is activated, movement of the blade reciprocates the thin abrasive strip against the inner surface of the shear plate to thereby recondition or hone the inner surface for improved operation with the sharpened blade. The length of the honing cycle will vary somewhat also depending upon the condition of the surface; however, normally operating the motor for about 30 seconds is sufficient to fully restore surface 60.

While the abrasive surface 58 and 70 may be deposited on a thin sheet of material, the formation of the abrasive element may also be accomplished by bonding a thin sheet of crocus cloth to a thin metallic material as shown in FIGS. 8 and 9. As shown in FIGS. 10 and 11, the thin sheet itself may be formed of crocus cloth having an abrasive on one side and shaped to conform to the shear plate and blade configuration.

The resilient mounting of the blade, a part of a conventional shaver construction, assures positive friction bearing between the blade and the abrasive material and between the inner surface of the shear plate and the abrasive material. When one blade has been sharpened and the shear plate reconditioned, the thin sheet abrasive elements may then be used for the next blade and shear plate.

While the invention has been described with respect to an electric shaver having a multi-head assembly, it will be realized that the invention may be equally applied to electric shavers having a head configuration other than that shown. It will be appreciated that the invention provides a very inexpensive sharpening means for an electric shaver since it consists only of a thin sheet material having an abrasive surface formed thereon. It is particularly light weight and may be easily carried in the normal container or kit for the shaver.

While a preferred embodiment of the invention has been illustrated and described in detail, it will be recognized by those skilled in the art that various modifications of the invention can be made without departing from the principles of the invention.

I claim:

1. In an electric shaver having an elongated head portion and a housing, the head portion having a cutter blade and a shear plate, means for honing the inner surface of the shear plate on an electric shaver, an elongated blade member positioned in and mounted for reciprocation with respect to said inner surface of the shear plate, and means securing said head portion in position on the shaver housing, the improvement in said honing means comprising:

a thin sheet positionable between said blade and said head, said thin sheet having a length and width corresponding generally to the length and width of said blade;

an abrasive surface formed on said thin sheet, said abrasive surface being positioned in engagement with said inner surface; and retaining means formed on said thin sheet adapted to engage said blade for retaining said thin sheet thereon for reciprocation with said blade whereby movement of said blade with respect to said inner surface will hone said inner surface, said retaining means including a base member on said thin sheet having a cross-sectional configuration corresponding generally to the top surface of said blade, said base member having a plurality of protrusions formed thereon extending downwardly from a lower surface thereof; said blade having a plurality of openings formed therein, said openings being adapted to receive said protrusions to retain said thin sheet on said blade.

2. The honing means of claim 1 wherein said abrasive material is formed on the upper surface of said base member.

3. The honing means of claim 2 wherein said abrasive means comprises crocus cloth fixed to said upper surface of said member.

4. In an electric shaver having an elongated head portion and a housing, the head portion having a cutter blade and a shear plate, means for honing the surface of the shear plate, an elongated blade member positioned in and mounted for reciprocation with respect to the inner surface of said shear plate, and means securing said head portion in position on the shaver housing, said securing means including means engaging said head portion at the ends thereof comprising:

a thin sheet between said blade and said inner surface, said thin sheet having a length and width corresponding generally to the length and width of said blade and extending along the length of said blade;

an abrasive surface formed on said thin sheet, said abrasive surface being positioned into engagement with one of said inner surface and said blade;

cooperative retaining means for retaining said thin sheet on said blade and between said inner surface and said blade and stationary with respect to said blade;

said retaining means comprising a base member on said thin sheet having a cross-sectional configuration corresponding generally to the top surface of said blade, said base member having a plurality of protrusions formed thereon extending downwardly from a lower surface thereof; said blade having a plurality of openings formed therein, said openings being adapted to receive said protrusions to retain said thin sheet on said blade; and said abrasive surface being positioned in engagement with said inner surface of said shear plate whereby reciprocation of said blade will simultaneously reciprocate said abrasive surface over said inner surface to hone finish said inner surface.

5. The apparatus of claim 4 wherein said abrasive material is formed on the upper surface of said base member.

6. The apparatus of claim 5 wherein said abrasive means comprises crocus cloth fixed to said upper surface of said base member.

7. In an electric shaver having an elongated head portion and a housing, the head portion having a cutter blade and a shear plate and resilient means normally biasing said cutter blade against said shear plate, means for sharpening the cutter blade, an elongated blade member positioned in and mounted for reciprocation with respect to the inner surface of said shear plate, and means securing said head portion in position on the shaver housing, said securing means including means engaging said head portion at the ends thereof comprising: a thin sheet seated between said blade and said shear plate and pressed by said cutter blade against the inner surface of said shear plate, said thin sheet having a lower surface overlying and engaging the entire cutting surface of said blade; said thin sheet having a length corresponding to the spacing between said engaging means at the ends of said head portion and being locked therebetween and held stationary; a layer of abrasive material on the lower face of that portion of said thin sheet which overlies the cutting surface of said blade whereby said blade is sharpened when it is reciprocated.

* * * * *

UNITED STATES PATENT AND TRADEMARK OFFICE

CERTIFICATE OF CORRECTION

PATENT NO. : 4,028,799

DATED : June 14, 1977

INVENTOR(S) : James E. Rookus

It is certified that error appears in the above-identified patent and that said Letters Patent are hereby corrected as shown below:

Column 1, line 23:
"paractice" should be --practice--

Column 1, line 53:
"ligh" should be --light--

Column 2, line 31:
"peforated" should be --perforated--

Column 3, lines 34 & 35:
"sutstrate" should be --substrate--

Column 4, line 26:
"sheets" should be --sheet--

Column 4, line 43:
"surface" should be --surfaces--

Column 5, line 6:
"I claim" should be --The embodiments of the invention in which an exclusive property or privilege is claimed are defined as follows.--

Column 5, line 42:
"said member" should be --said base member--

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*